US007414214B2

(12) United States Patent
Fausch

(10) Patent No.: US 7,414,214 B2
(45) Date of Patent: Aug. 19, 2008

(54) CONTACT ARRANGEMENT FOR A RELAY

(75) Inventor: Werner Fausch, Buchs (CH)

(73) Assignee: Elesta Relays GmbH, Bäd Ragaz (CH)

( * ) Notice: Subject to any disclaimer, the term of this patent is extended or adjusted under 35 U.S.C. 154(b) by 281 days.

(21) Appl. No.: 11/429,067

(22) Filed: May 8, 2006

(65) Prior Publication Data

US 2006/0255688 A1 Nov. 16, 2006

(30) Foreign Application Priority Data

May 10, 2005 (CH) ..... 0821/05
Mar. 24, 2006 (CH) ..... 0455/06

(51) Int. Cl.
*H01H 5/00* (2006.01)

(52) U.S. Cl. ..... 200/402; 200/341; 335/128; 335/80

(58) Field of Classification Search ..... 200/402–407, 200/283, 532, 341–345, 310–317; 335/128–131, 335/78, 80
See application file for complete search history.

(56) References Cited

U.S. PATENT DOCUMENTS 4,904,832 A * 2/1990 Nagahara et al. ..... 200/402
4,967,043 A * 10/1990 Killarney ..... 200/1 B
5,017,747 A * 5/1991 Nagahara et al. ..... 200/453
6,847,000 B1 * 1/2005 Marchini et al. ..... 200/402
6,919,523 B1 * 7/2005 Lai ..... 200/402
6,998,555 B2 * 2/2006 Collot et al. ..... 200/412
7,081,593 B2 * 7/2006 Hopkins ..... 200/402
2004/0069606 A1 * 4/2004 Lee ..... 200/402
2005/0109601 A1 * 5/2005 Collot et al. ..... 200/402

* cited by examiner

*Primary Examiner*—Michael A Friedhofer
*Assistant Examiner*—Lisa N Klaus
(74) *Attorney, Agent, or Firm*—Buchanan, Ingersoll and Rooney

(57) ABSTRACT

The invention relates to a contact arrangement of a relay with a contact head (11) with a crown (17) which encloses a contact surface (15) and is raised with respect to the contact surface. According to the invention, for increasing the contact reliability with a dry switching load, this crown (17) is interrupted at a multitude of locations, by which means teeth (21) and intermediate spaces between the teeth (21) are formed. This crown contact head in the closed position of the contact arrangement bears on a crownless contact head. The contact spring (23) carrying the movable contact head is designed in a manner such that it may be subjected to torsion. The result of this is that the crown contact head (11) reliably contacts the crownless adjacent contact head (25) at the two small-surfaced contact locations, in each case with a high specific surface pressing.

19 Claims, 7 Drawing Sheets

CONTACT ARRANGEMENT FOR A RELAY

The invention relates to a contact arrangement for a relay with a contact head which is provided with a crown, in particular for "dry" switch loads, and to a relay with such a contact arrangement.

An electrical contact head and a method for manufacturing the same is known from JP 56-107418. The drawing of this document shows a circular disk with nine teeth which are arranged along the periphery of the circular disk. These teeth serve for the fastening by way of cold welding the contact head on a contact head carrier.

A contact arrangement for switch apparatus is known from DE 31 28 929. With this contact arrangement, a contact head has a crown with a contact line closed in a circular manner. A second contact head cooperating with this contact head likewise has a contact line. This may be straight-lined, but may also be designed in a circular manner as a crown. The contact lines of the two cooperating contact heads cross, so that in each case two crossing points arise, at which the contact heads may contact.

An electrical contact pair is known from DD 150 699, with which the contact heads have circular outlines and are symmetrical to an axis through the centre of the circle of the outline. The contact surface of such a contact head is formed peripherally convexly at the edge. This convex bead merges into a concave surface towards the centre. The bead may comprise recesses. The other contact may be convexly curved. With a contact pair formed in such a manner, the transition resistance and the consumption may be reduced. Further advantages are a large resistivity with respect to the asymmetry of the switch location, a cooling of the contact surface as a result of their enlargement, and extension of the total life expectancy, and an increase in the reliability. A relay is known from the German utility model DE 90 06 430.5 U which is applied in so-called dry-switching switch circuits, or switching circuits with a low load. For reducing or avoiding the disadvantages which are caused by the contamination layer resistance, it is suggested to provide one or more raised parts projecting in a relief-like manner in the direction towards the other contact, on one or both of the contacts of a contact pair. The contact surface area at the contact location is greatly reduced and the contact pressure is increased by way of this. The raised parts are formed by embossing a curved contact surface centrically on this, and are merely raised by 5 to 100, preferably by 10 to 50 micrometers with respect to the remaining contact surface.

It is the object of the present invention to suggest a relay, a contact head and a contact arrangement with which the contact reliability is high with a "dry" switch load (sparkless making and breaking). In particular, an as large as possible specific contact pressure at the contact locations of two contact heads and simultaneously, a two point contact is to be achieved in a reliable manner. In particular, the contact head should abut with a second contact head which is formed without a crown and in a smooth manner, at not less that two contact locations having a small surface area.

This object is achieved by the subject-matters of the independent claims.

A relay according to the invention has at least one contact arrangement for the dry switching of an electric circuit, in a manner known from DE 90 06 430.6 U. With a contact arrangement according to the invention, a first contact head is present in the known manner, which has an annular crown, and a second contact head which with a contact surface formed without a crown, cooperates with a contact surface with the first contact head. The diameter of the crown is smaller than the diameter of the contact surface of the second contact head. One of the contact heads is arranged and movable on a contact spring. The two contact heads are inclined to one another in the closed position, so that the crown does not circumferentially bear on the counter-contact, but is only pressed on at a small circular segment. A relatively high pressing pressure is achieved by this.

According to the invention, the object of the invention is achieved on the one hand by way of the crown being formed by a plurality or multitude of teeth which are separated from one another by interruptions in the crown, and on the other hand by way of the contact spring being formed such that it may be subjected to torsion. By way of this, one ensures that two teeth of the first contact head always lie on the contact surface of the second contact head in the closed position.

Thus, it is also ensured that an individual grain at the contact location of the two contact heads which separates the contact heads, as a whole may not prevent the electrical contact. The contact head arranged on the contact spring in this case is twisted about the axis of the contact spring by way of the fact that contact spring is placed under torsion, until a second tooth of the crown bears on the contact surface of the counter-contact, and thus current may flow. With this, a two-point contact is achieved, which is more reliable than the single-point contact which has been realised in DE 90 06 430.6 U.

In a preferred embodiment, the teeth are arranged at a distance to the periphery of the contact head at regular distances. The distance to the periphery of the contact head ensures that the teeth, with an equally large counter-contact, fall into the inside of the contact surface and do not snag at the edge of the contact surface with the counter-contact.

The crown has a diameter which is between a third and two thirds of the diameter of the first contact head. Preferably, the diameter of the crown has maximally the diameter of the rivet stub, particularly preferably it corresponds to the diameter of the rivet stub. This permits a large force onto the location of the rivet head, on which the crown is to be formed by cold forming.

For manufacturing a crown contact head by way of a cold-forming method, the contact head is firstly formed with an annular crown, and interruptions are formed into this annular crown, e.g. with a spoke-wheel-like punch, at a later stage. A crown of alternating teeth and interruptions between the teeth results by way of this.

The interruptions are usefully formed not until riveting the contact head into a contact head carrier. This permits the position of the teeth to always be aligned equally with respect to the contact head carrier, thus e.g. a contact spring or a stationary plate. An interruption is formed on an axis of the contact spring. The crown thereby does not need to form a complete circle, but may merely be present around the axis of the contact spring, but may be absent at a larger lateral distance to this axis, since the contact head is subjected to torsion until the next tooth bears on the counter contact.

With a contact head for a contact arrangement of a relay with a crown which encloses the contact surface and projects with respect to the contact surface and which forms a contact edge, according to the invention, the edge of the projecting crown is interrupted at a multitude of locations, so that teeth and intermediate spaces between the teeth are formed.

If such a toothed crown is pressed onto a smooth, plane or curved contact surface of a second contact head of a contact arrangement, then a slight spring force is adequate in order to achieve a high specific surface pressing at the contact locations. This high pressing pressure is achieved because the teeth abut on the smooth contact surface at contact locations having a small surface area. Furthermore, the two contact heads reliably bear on two contact locations, since the contact head with the toothed crown will only accommodate the spring force in a torsionally-stable manner, when the contact heads contact one another at two locations which are distanced to one another. These two locations both have a very small surface area with the contact heads according to the invention.

The crown is usefully formed by a multitude of teeth on the periphery of the contact head which increasingly taper the further from the contact surface. The tapering may be designed running out, so that the contact edge is formed very sharply up to 0.1 mm width. On account of the tapering of the teeth, these have a stable base despite the minimal dimension of the contact edge, so that the teeth do not yield to the contact pressure and thus do not deform. The multitude of teeth ensures that the arrangement of the contact head on the leaf spring of the contact may be effected with any alignment of the teeth, and in each case two teeth create a reliable two-point contact in every possible arrangement of the teeth even with a very slight torsioning of the leaf spring.

The contact edge between the interruptions preferably has a length of 0.01 to 0.7 millimetres, preferably 0.01 to 0.2 millimetres, particularly preferably 0.02 to 0.1 mm. These dimensions limit the maximal size of the contact surface of a contact head. The contact surface of an individual tooth in the meanwhile may be even smaller than the length times the width of the contact edge of two teeth, since in most cases each tooth abuts the opposite contact head only with a single end point of the end points of the contact edge which are present at each tooth.

The teeth are usefully arranged on the periphery of the contact head at regular distances to one another. By way of this, no position of the contact head is then to be preferred over the other one, but each position is equivalent to the other. The number of teeth is dependent on the periphery of the crown, and depending on the diameter of the crown, preferably lies in a range of 10 to 60. Preferably 24 to 40 teeth are present with a diameter of the crown of approx. 2.4 mm.

The teeth advantageously in each case comprise a flank shaped running-out towards the contact surface enclosed by the crown. This prevents the occurrence of fractures (e.g. stress fractures) in the contact head.

The contact surface which is enclosed by the crown is advantageously formed smoothly and plane-surfaced or slightly cambered. A central wart may be formed on the contact surface, in order to have as much as possible wearable material thereon with the use of a head in a "wet-switching" contact, i.e. a contact with burn-off.

The contact head is usefully a rivet head with a finished shaped contact body with a crown and a formable rivet stub on the rear side thereof. A riveting swage may be used for riveting the rivet head, as is used for crown contact heads without teeth.

However, welding contacts or soldering contacts may also be provided with a crown toothed according to the invention.

With a contact arrangement for a relay or in a relay with at least two contact heads, with which a first contact head is formed with a projecting crown enclosing a contact surface, said crown forming a contact edge, according to the invention, the edge of the projecting crown is interrupted at a multitude of locations, by which means teeth are formed. The contact heads are usefully arranged on contact springs, in particular are riveted, soldered or welded on. These contact springs are leaf springs which allow a certain torsioning. They therefore increase the reliability which is ensured in any case with a two-point contact.

The second contact head cooperating with the first contact head in the meanwhile is advantageously formed without a crown. It merely forms a smooth counter-piece, on which the first contact head abuts with the crown at a certain angle. For this reason, the second contact head for this reason best has a smooth, plane-surfaced or slightly curved contact surface.

The first and the second contact head are usefully arranged relative to one another such that the first contact head with the crown contacts the contact surface of the second contact head at a distance to the edge of this contact surface. This may e.g. be achieved in that the second contact head has a larger diameter than the first contact head. The contact heads may however also bear on one another eccentrically to one another. Then, in the contact position, only the crown contact with the toothed crown needs to be inclined with respect to the second contact head. The frontmost location of the inclined crown must then abut on the second contact head within the contact surface of this second contact head.

Figure 1:
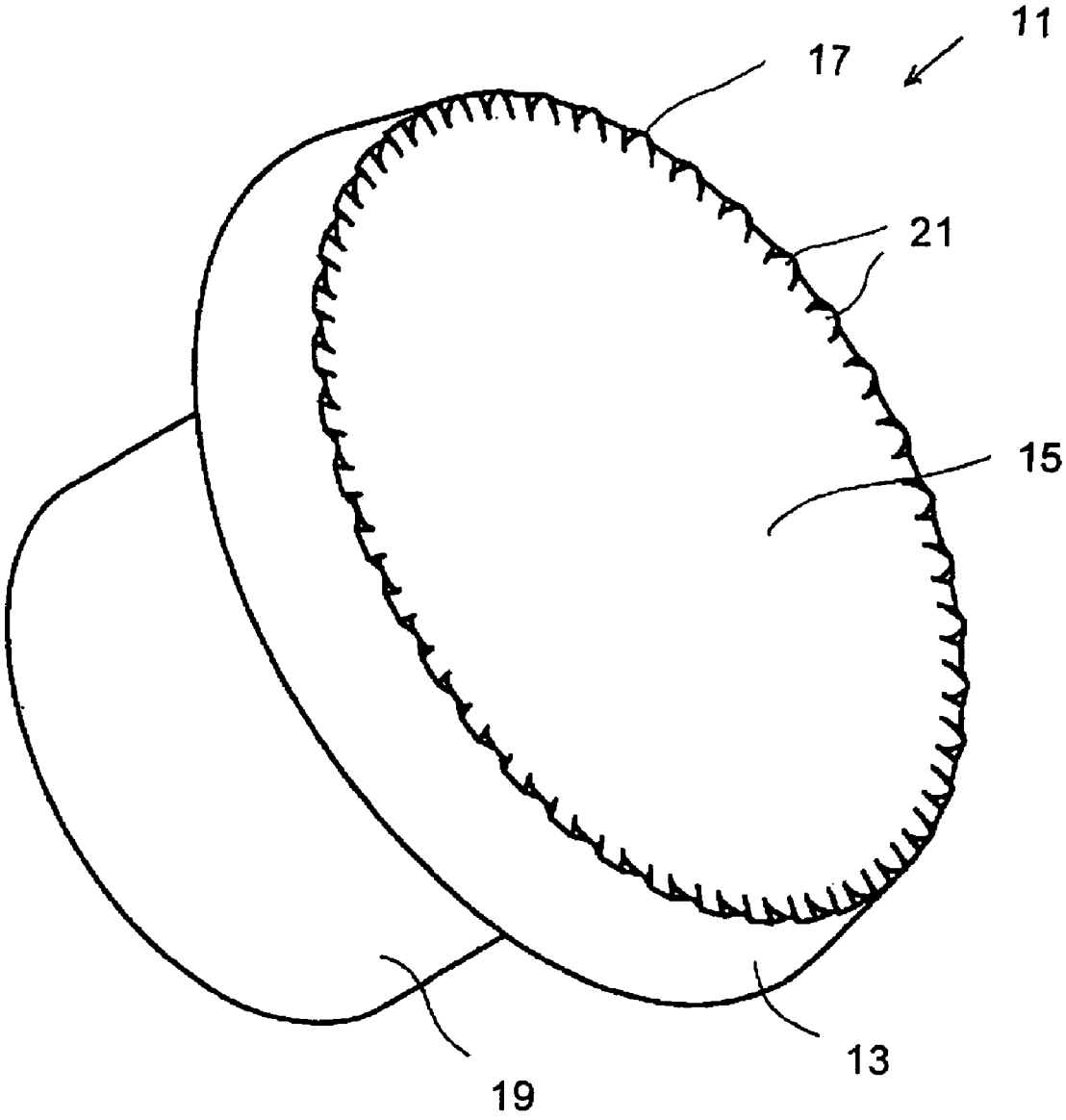
FIG. 1 shows a perspective drawing of a rivet head with a toothed crown.

The contact head 11 represented in FIG. 1 is a rivet head. It thus has a contact body 13 with a contact surface 15 which is edged by a crown 17. On the rear side, it comprises a rivet stub 19 arranged on the contact body 13, and this rivet stub for fastening the contact head 11 on a leaf spring is inserted through a hole in the leaf spring and must be struck. With regard to the illustrated contact head 11, the crown 17 is formed from 40 teeth. This number however is dependent on the crown periphery and on the fineness of the teeth. The contact surface is formed with a plane surface between the teeth 21, and specifically the contact surface enclosed by the teeth as well as in the intermediate spaces between two adjacent teeth 21. The contact head may however also be slightly cambered or be provided with a conventional wart. The elevation in the middle region of the contact surface should however not project beyond the plane which is formed by the tips of the teeth 21.

The teeth 21 have a tip which is formed by one edge. This edge lies on a circular line and with each tooth 21 has a length for example of 0.02 mm. The length and width of the edge may have dimensions lying in a wide range. The flanks of the teeth 21 are formed descending in an inclined manner from this edge towards the contact surface 15. The flank inclined towards the centre of the head 11 in each case is formed running out in a concavely curved manner.

Figure 2:
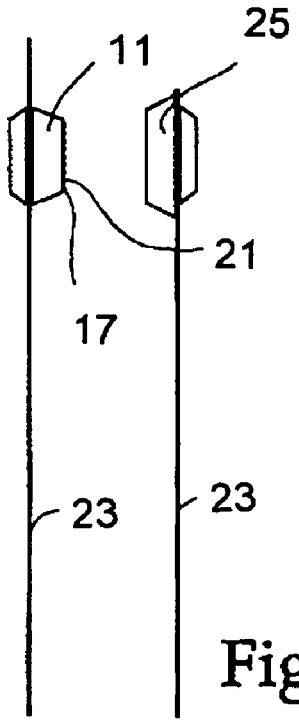
FIG. 2 shows a contact arrangement with such a rivet head.
Figure 3:
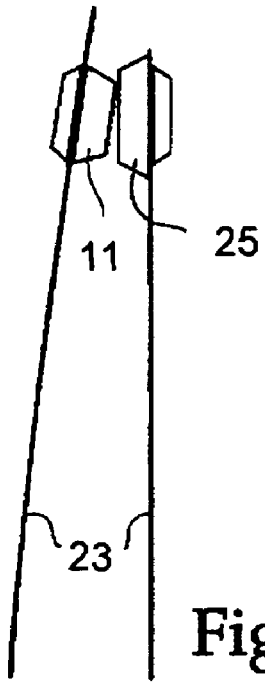
FIG. 3 shows the contact arrangement according to FIG. 2 in a closed position.

In the contact arrangement represented in FIGS. 2 and 3, two cooperating spring contacts are opposite one another. Two leaf springs 23 in each case carry a contact head. Of these contact heads, only one is a contact head 11 with a toothed crown, according to the invention. The other contact head 25 is formed in a smooth manner. A crown on the second contact head 25 would increase the risk of a snagging of the two contact heads.

The contact arrangement according to these figures may be a closing contact or a break contact. With the abutment of the two contact heads 11 and 25 on one another, a tangential movement (circular movement) of the two heads against one another arises, which accounts for a mechanical cleaning of the contact location. When the two contact heads abut one another, then the toothed crown with two teeth bears on the plane or slightly convexly curved contact surface of the smooth contact head 25. These teeth 21 bear with a very small surface, so that even with a slight pressing force of the spring, a high specific surface pressing (a high pressing pressure) arises.

Figure 4:
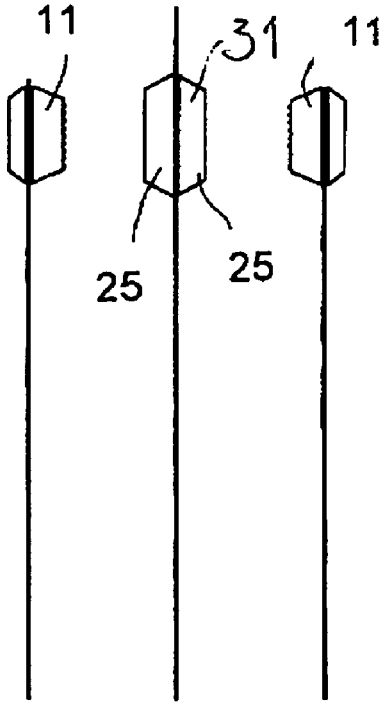
FIG. 4 shows an alternating contact arrangement, with two resting contact heads according to the invention, each with a smooth alternating contact head on both sides.
Figure 5:
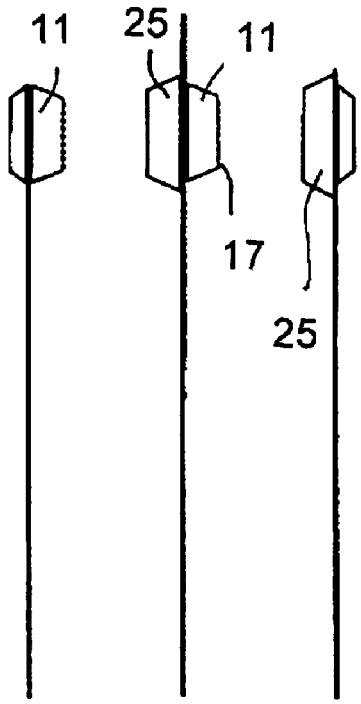
FIG. 5 shows an alternating contact arrangement with an alternating contact head, with a contact head according to the invention on one side, and a smooth, struck contact head on the other side.

As is shown in FIGS. 4 and 5, alternating contacts may also be provided with contact heads according to the invention. Although a formation of a struck head with a toothed crown is theoretically possible, it may be ruled out in practise. Struck contact heads for this reason are formed as smooth contact heads 25 in these illustrations. In FIG. 4, the two resting contact springs are each provided with a contact head according to the invention. A movable contact spring with a double contact head 31 is formed between these. This double contact head 31 is premanufactured on one side and is struck on the other side. The middle and movable contact spring is likewise formed with a double head in FIG. 5. This however is provided with a toothed crown 17 on the premanufactured side. The head however is formed smoothly on the struck side. The flat or curved, struck head is an abutment for the resting contact head 11 according to the invention. The movable contact head 11 with the toothed crown 17 abuts against a smooth, premanufactured contact head 25.

The diameter of the smooth contact heads cooperating with the contact heads according to the invention is indeed shown larger than the diameter of the toothed crown 17 in the examples. This however is not necessary with a suitable position of the contact heads. The only condition is that the teeth of the toothed crown contact the adjacent contact head on an approximately smooth contact surface.

Figure 6:
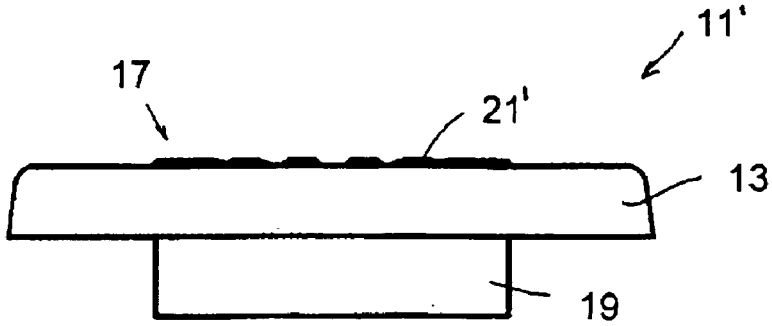
FIG. 6 shows a lateral view of a contact head with a toothed crown.
Figure 7:
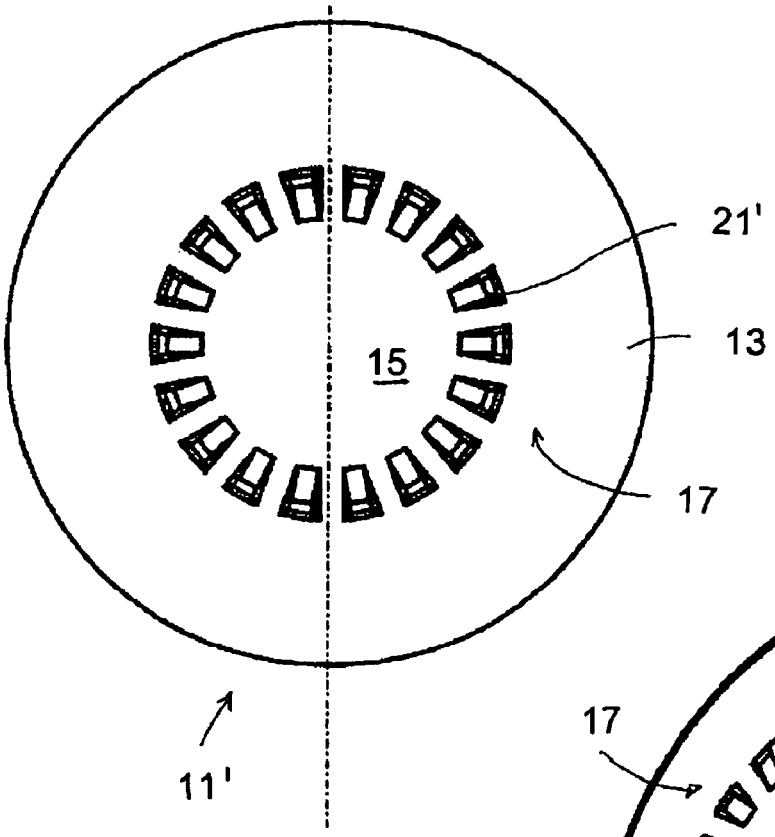
FIG. 7 shows the contact head according to FIG. 6 in a frontal view.
Figure 8:
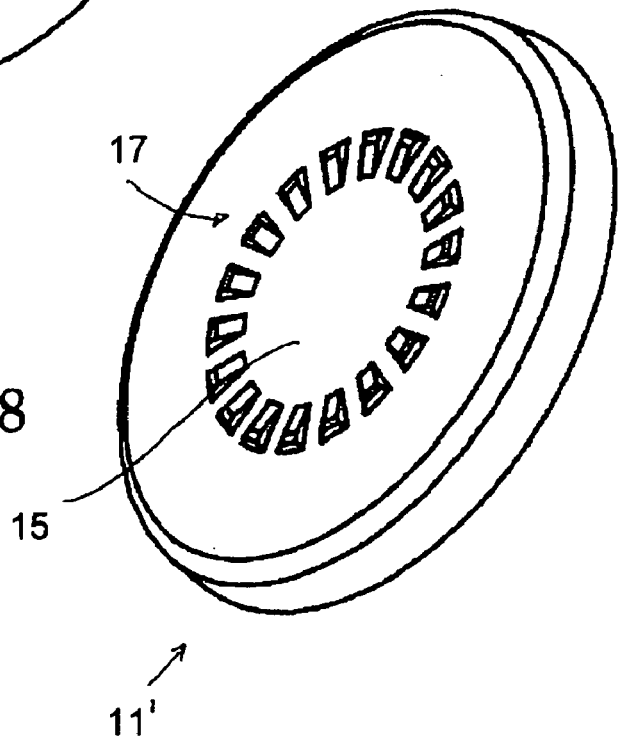
FIG. 8 shows the contact head represented perspectively.

The contact head 11' represented in the FIGS. 6 to 8 has a crown 17' of a multitude of teeth 21'. The crown is formed at a distance to the periphery of the contact head. The diameter of the crown corresponds to the diameter of the rivet stub. The crown diameter measures a little more than half the diameter of the head.

The teeth 21' are formed having a sharp edge. The rivet head 11' has a plane-surfaced contact surface 15 on which the teeth 21' are arranged. The teeth 21 are about 30 micrometers high (15 to 60, preferably 20 to 40 micrometers). The distance between two teeth is about 10 times as large as the tooth height (approx. 0.3 mm, preferred range: 0.2 to 0.5 mm). The width of the tooth tip in the direction of the periphery of the crown is about half as wide as the width of the distance between the teeth (preferred region 0.1 to 0.3 mm).

With a contact head with an annular crown, the teeth are manufactured by way of cold forming the interruptions between the teeth. The material of the crown is displaced into the base body of the contact head at the interruptions and into the adjacent teeth. By way of this, the edges of a tooth 21' adjacent the interruption are somewhat elevated. These edges then form the contact point to a plane-surfaced contact surface of a counter-contact.

The forming of the interruptions is preferably effected in a single method step together with the riveting of the contact head with a contact head carrier, thus of a contact spring of a movable contact, or a plate of a fixed contact.

Since the positioning of the teeth with respect to the contact spring or the plate is defined with such a method for forming the toothed crown of the contact head, one may do away with those teeth in the toothed crown which definitely do not cooperate with the counter-contact. Here, one may do away with the formation of interruptions, or the crown as a whole may be omitted or pressed away. The contact heads according to the FIG. 6 to 11 therefore, if manufactured with the preferred method, are wrongly not arranged on a contact head carrier. With a rivet stump which is represented in an unpressed manner, the crown would also have to be represented without teeth.

Figure 9:
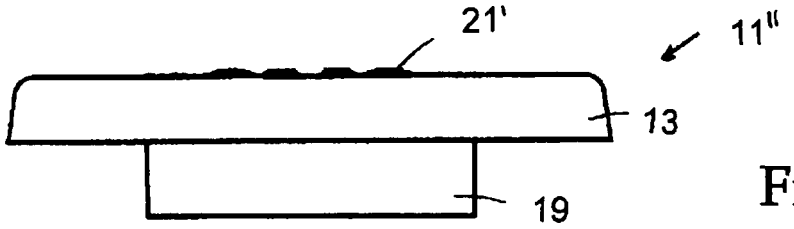
FIG. 9 shows a view of a contact head with a partial toothed crown.
Figure 10:
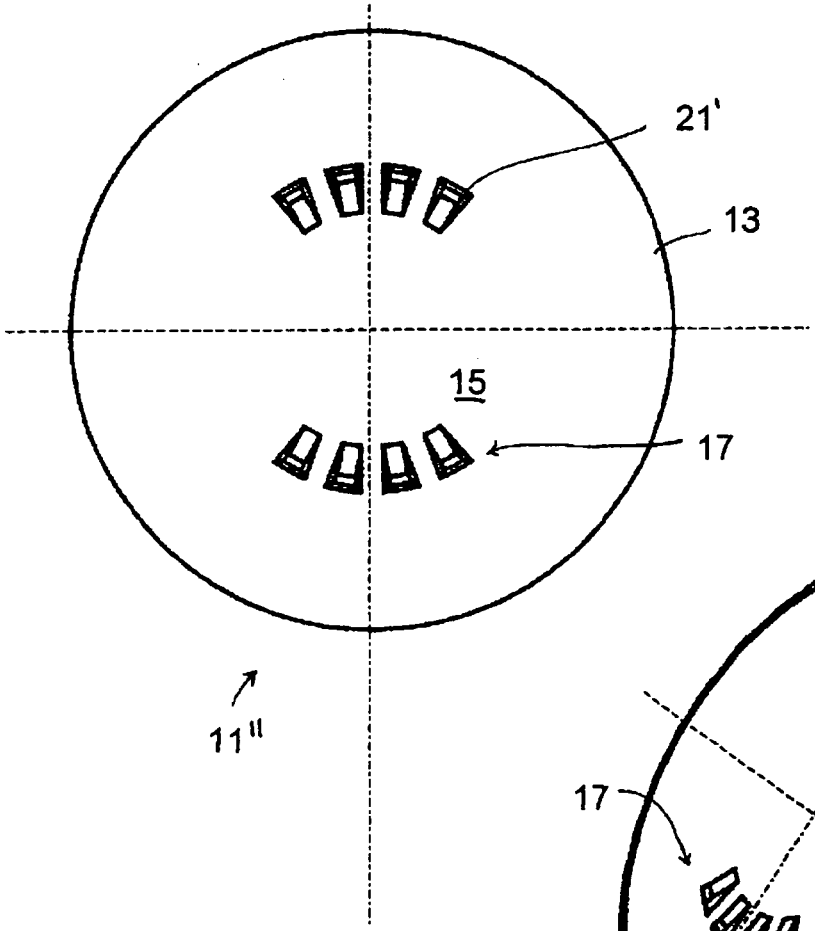
FIG. 10 shows the contact head according to FIG. 9 in a front view.
Figure 11:
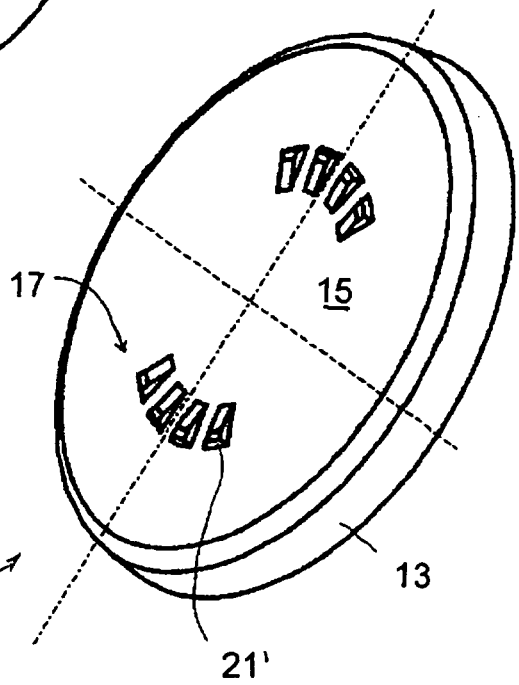
FIG. 11 shows the same contact head, represented perspectively.

With the contact head according to FIGS. 9 to 11, the axis of a contact head carrier is represented as a dot-dashed line. In each case only two teeth 21' are formed laterally connected to this axis. With this embodiment example, with an assembly of the contact head onto a contact head carrier, only 8 teeth 21' are formed. In the assembled relay, two teeth 21' lying closest the axis then cooperate with the counter-contact. Depending on the type of the counter-contact, it is the two teeth which are distanced from the foot end of the contact head assembled on the contact spring or those lying closest.

In order to obtain a larger lever and thus a larger force for the torsioning of the contact springs, the contact head according to FIGS. 9 to 11 may also be assembled such that the axis of the contact spring runs along the dashed line. The contact heads which then lie closest to this axis are arranged at a relatively large distance to the axis. For this reason, a larger force placing the contact spring under torsion results when the crown contact merely lies on the teeth.

Figure 12:
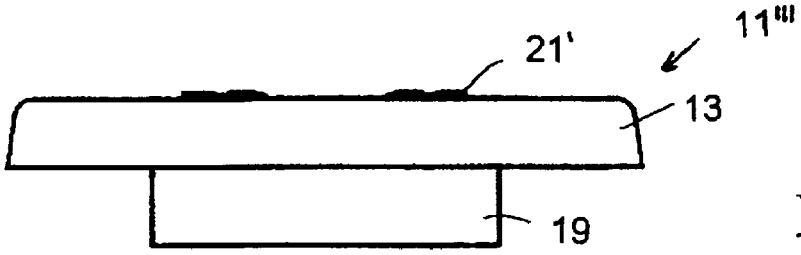
FIG. 12 shows a view of a contact head with teeth at four edges.
Figure 13:
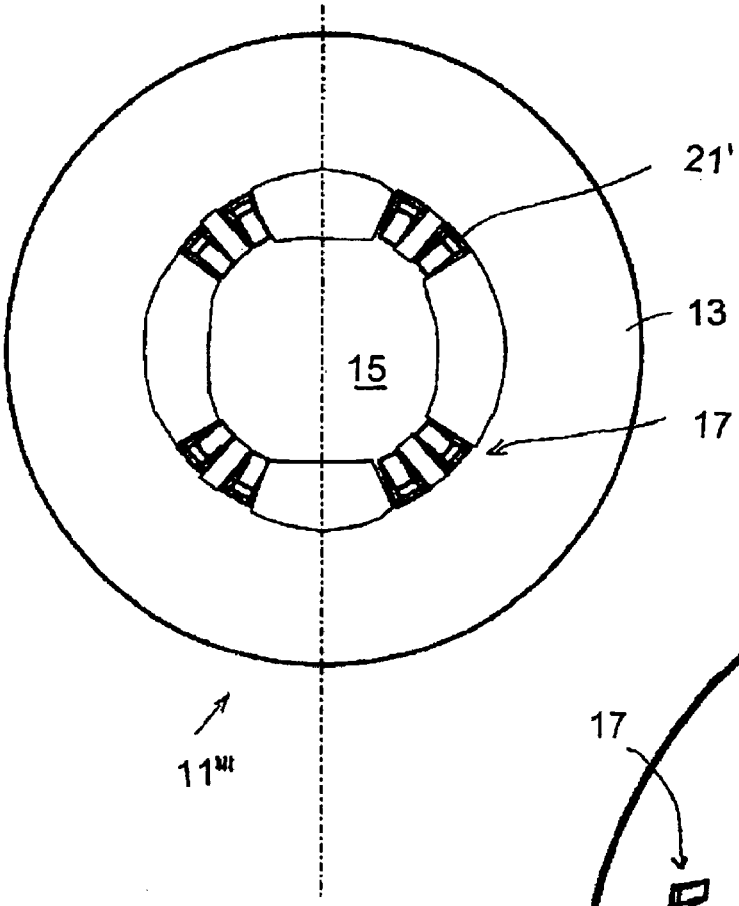
FIG. 13 shows the contact head according to FIG. 9 in a front view.
Figure 14:
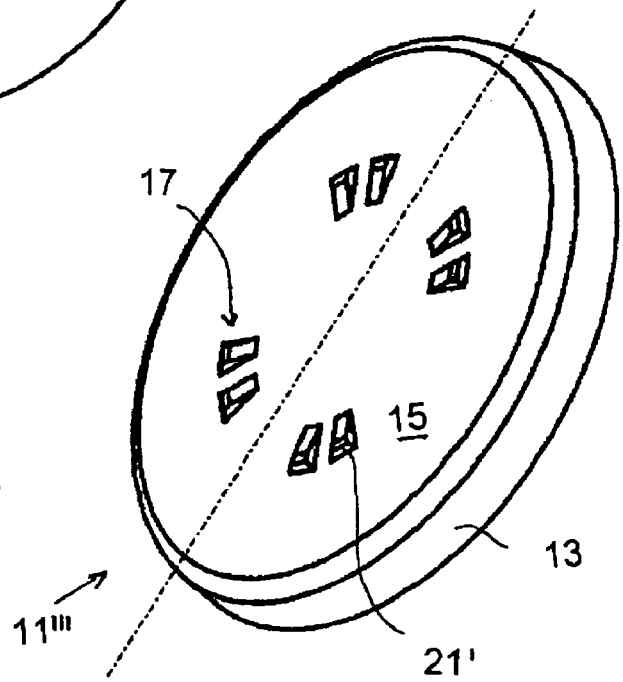
FIG. 14 shows the same contact head, represented perspectively.

A contact head which only has 8 teeth, which in each case are arranged in pairs in the corners of a rectangle approximated to a square, is represented in the FIGS. 12, 13 and 14. Also only four teeth may be formed, one in each corner.

If a contact element consisting of a contact head and contact head carrier is only to be able to be applied for a closing contact or a break contact, but not for both types of contacts, then one may do away with the upper or lower contacts. The symmetrical formation with respect to an axis perpendicular to the axis of the contact spring permits the application of the same contact members with closing contacts and break contacts.

It is further shown in FIG. 13 that the regions in which the crown is pressed together, on account of production technology, may be slightly raised or also recessed with respect to the contact surface, in order to achieve an interruption between two teeth.

Figure 15:
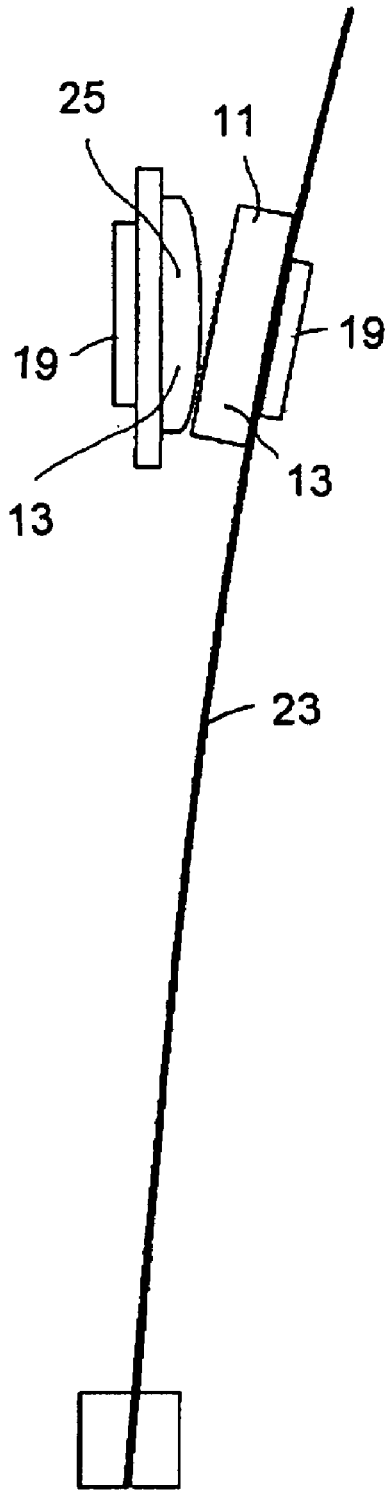
FIG. 15 shows a break contact in the closed condition.
Figure 16:
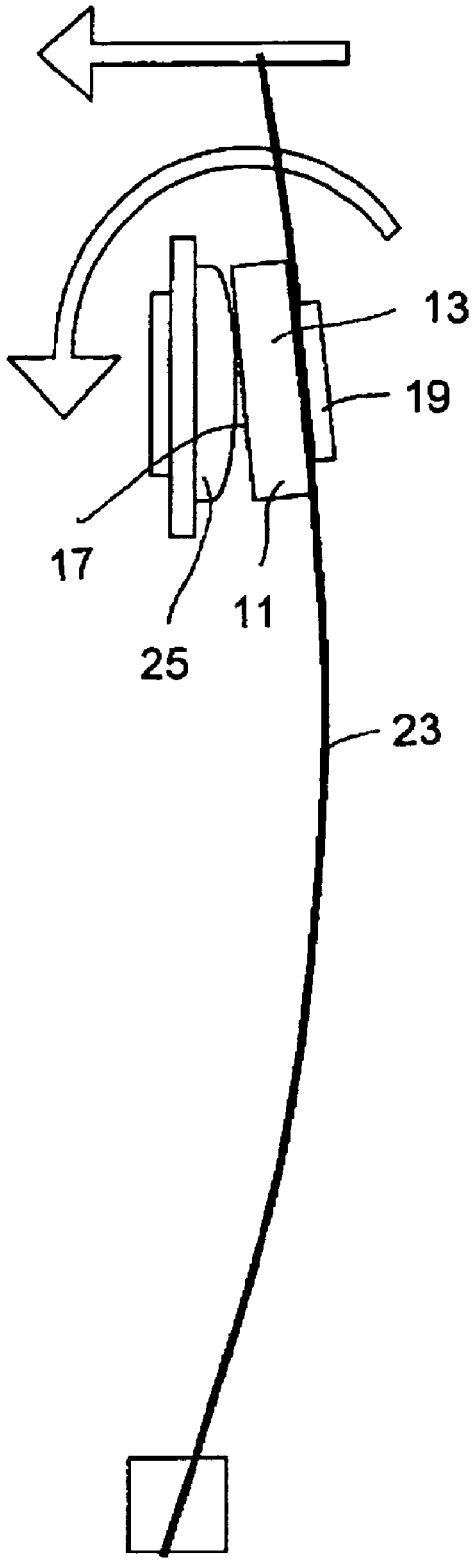
FIG. 16 shows a closing contact in a closed condition.

Two different contact pairs are represented in FIGS. 15 and 16. With the closed break contact according to FIG. 15, the teeth lying closest to the foot end of the contact spring bear on the counter-contact. With a closed closing contact according to FIG. 16, the teeth more remote from the foot end bear on the counter-contact. The counter-contact is slightly cambered. The contact surface which is curved towards the crown contact, in the inside of a central region with the radius of the crown has a curvature height which is smaller than the height of the teeth. The teeth always bear on the curved contact surface of the counter-contact by way of this.

Furthermore, the course of the movement of the contacting is shown in FIG. 16. The drive end of the contact spring is bridged (straight arrow). This means that the drive cam in the relay presses the drive end further against the counter-contact than is indeed necessary for a contacting of the two contact heads. Thereby, the contact spring is bent further (circular arrow) after the contact head already bears with two edges on the contact surface of the counter contact. Thereby, the contact head participates in the movement of the contact spring which bends further, and thus with the two bearing edges scratches over the surface of the counter contact. By way of this, it is ensured that a separating layer which may be present on the contact heads as the case may, is scraped through.

Figure 17:
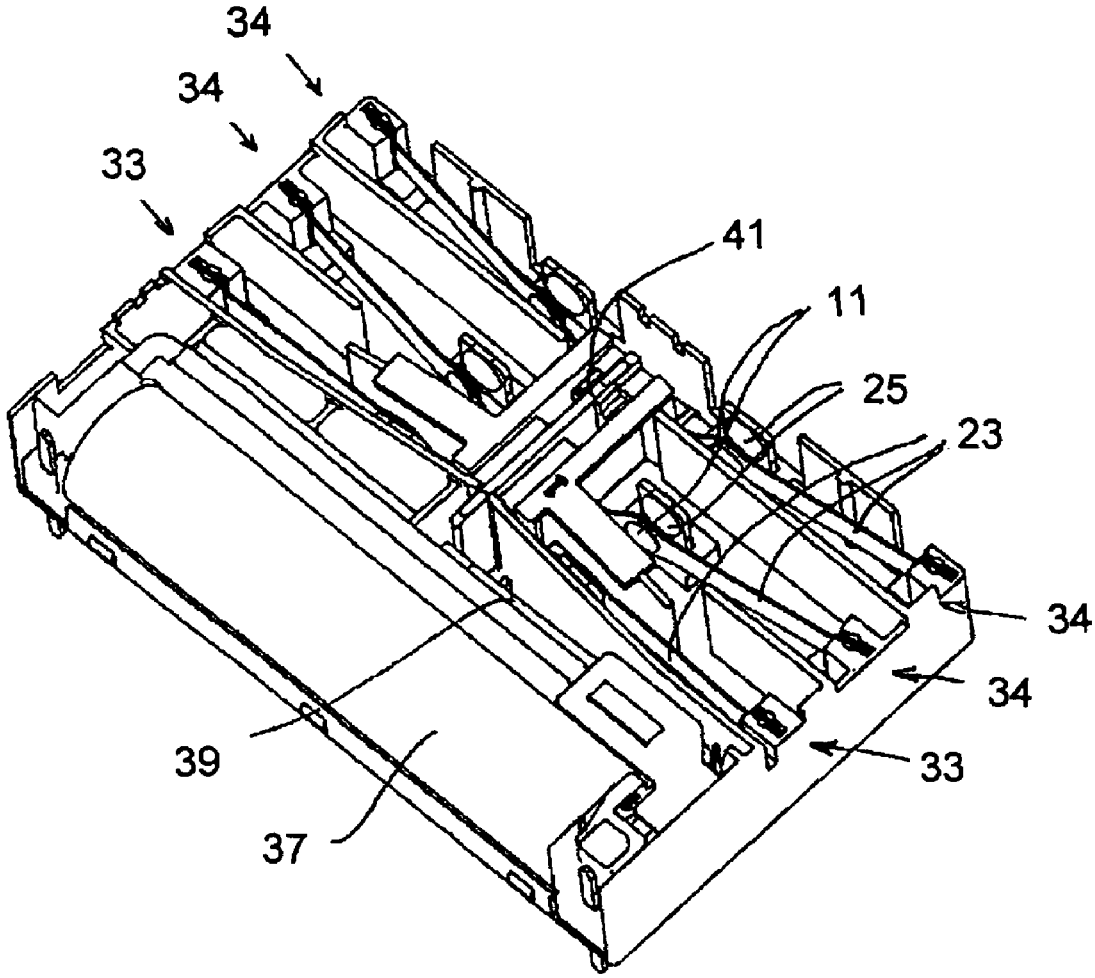
FIG. 17 shows a perspective representation of a relay according to the invention.

FIG. 17 shows a relay according to the invention with several contacts, with which a toothed crown contact head and a crownless counter contact cooperate. The shown relay has two break contacts 33 and four closing contacts 35. Such relays may be designed with two rows as shown, or only with one row. With a single-row relay, only one break contact 33 is present, but one to three closing contacts 35. The drive 37, the armature 39 and the drive cam 41 are evident from FIG. 14, with the help of which the movable contact springs 23 may be moved.

The invention, expressed briefly, relates to a contact pair of a relay, with a contact head which comprises a crown 17 enclosing a contact surface 15 and projecting with respect to the contact surface. The crown has an edge which is interrupted at a multitude of locations, by which means teeth 21 and intermediate spaces between the teeth 21 are formed. The result of this is that the crown contact head 11 contacts a smooth, crownless adjacent contact head in each case with a high pressing pressure at two small-surfaced contact locations in a reliable manner, despite a low spring force. The contact reliability with a dry switching load may be increased with respect to conventional crown contacts by way of this.

The invention claimed is:

1. A contact arrangement for the dry switching of an electric circuit, having:

a first contact head, which has an annular crown formed by a plurality of teeth separated by interruptions;

a second contact head with a crownless contact surface, wherein:

the diameter of the crown is smaller than the diameter of the contact surface of the second contact head, one of the contact heads is arranged on a contact spring and is movable relative to the other contact head, which contact spring is designed able to be subjected to torsion, the second contact head cooperates with the first contact head in such manner, that in the closed position the two contact heads are inclined to one another;

by which means in the closed position, at least two teeth of the first contact head lie on the contact surface of the second contact head.

2. A contact arrangement according to claim 1, wherein the teeth comprise contact edges with a length of 0.01 to 0.7 millimetres, preferably 0.01 to 0.2 millimetres, in particular preferably 0.02 to 0.1 mm.

3. A contact arrangement according to claim 2, wherein the teeth are arranged at a distance to the periphery of the contact head.

4. A contact arrangement according to claim 1, wherein the teeth are arranged at regular distances to one another.

5. A contact arrangement according to claim 4, wherein the teeth are arranged at a distance to the periphery of the contact head.

6. A contact arrangement according to claim 1, wherein the teeth are arranged on the periphery of the contact head.

7. A contact arrangement according to claim 1, wherein the teeth are arranged at a distance to the periphery of the contact head.

8. A contact arrangement according to claim 1, wherein the contact surface enclosed by the crown is formed plane-surfaced.

9. A contact arrangement according to claim 1, wherein the contact head is a rivet head with a finished shaped contact body and at the front side thereon has a crown with teeth, and on the rear side thereon is riveted with a rivet stub onto a contact head carrier.

10. A contact arrangement according to claim 9, wherein the diameter of the crown maximally has the diameter of the rivet stub, preferably the diameter of the rivet stub.

11. A contact arrangement according to claim 1, wherein the second contact head has a slightly curved contact surface.

12. A contact arrangement according to claim 11, wherein the diameter of the crown maximally has the diameter of the rivet stub, preferably the diameter of the rivet stub.

13. A contact arrangement according to claim 1, wherein the second contact head has a larger diameter than the first contact head.

14. A contact arrangement according to claim 13, wherein the diameter of the crown maximally has the diameter of the rivet stub, preferably the diameter of the rivet stub.

15. A contact arrangement according to claim 1, wherein the crown has a diameter which is between a third and two thirds of the diameter of the first contact head.

16. A contact arrangement according to claim 15, wherein the diameter of the crown maximally has the diameter of the rivet stub, preferably the diameter of the rivet stub.

17. A relay with at least one contact arrangement according to claim 1.

18. A method for manufacturing a crown contact with which the contact head is cold formed, wherein with the cold forming of the contact head, this is formed with an annular crown, and at a later stage, interruptions are formed into the annular crown, e.g. with a spoked-wheel-like punch, so that alternating teeth and interruptions between the teeth are formed.

19. A method according to claim 18, wherein the interruptions between the teeth are formed into the crown on riveting the contact head into a contact head carrier.

* * * * *